US008664925B2

(12) United States Patent
Sudou et al.

(10) Patent No.: US 8,664,925 B2
(45) Date of Patent: Mar. 4, 2014

(54) VOLTAGE REGULATOR

(75) Inventors: Minoru Sudou, Austin, TX (US); Yotaro Nihei, Chiba (JP)

(73) Assignee: Seiko Instruments Inc., Chiba (JP)

( * ) Notice: Subject to any disclaimer, the term of this patent is extended or adjusted under 35 U.S.C. 154(b) by 343 days.

(21) Appl. No.: 13/052,296

(22) Filed: Mar. 21, 2011

(65) Prior Publication Data

US 2011/0169465 A1 Jul. 14, 2011

Related U.S. Application Data

(63) Continuation-in-part of application No. 12/559,966, filed on Sep. 15, 2009, now Pat. No. 8,198,875.

(30) Foreign Application Priority Data

Jul. 26, 2010 (JP) ..... 2010-167460

(51) Int. Cl.
*G05F 1/575* (2006.01)

(52) U.S. Cl.
USPC ..... 323/274; 327/59; 327/534

(58) Field of Classification Search
USPC ..... 323/273–276, 279, 280, 301, 223–224; 327/59, 66, 534
See application file for complete search history.

(56) References Cited

U.S. PATENT DOCUMENTS 7,589,510 B2 * 9/2009 Bodano ..... 323/284

FOREIGN PATENT DOCUMENTS

JP 2001-051735 A 2/2001

* cited by examiner

*Primary Examiner* — Harry Behm
(74) *Attorney, Agent, or Firm* — Brinks Gilson & Lione

(57) ABSTRACT

Provided is a voltage regulator having low current consumption, which is capable of preventing a reverse current from flowing thereto from an output terminal (122), irrespective of a magnitude of a voltage of a VDD terminal (121). The voltage regulator has a circuit configuration in which voltage dividing resistors are not used for a comparator circuit for comparing the voltage of the VDD terminal (121) with a voltage of the output terminal (122), to thereby achieve lower current consumption.

9 Claims, 11 Drawing Sheets

| SECTION | CONT VOLTAGE | CONTX VOLTAGE |
|---|---|---|
| A | "L"(VOLTAGE OF VSS TERMINAL) | VOLTAGE OF VDD TERMINAL |
| B | "H"(VOLTAGE OF VOUT TERMINAL) | "L"(VOLTAGE OF VSS TERMINAL) |
| C | "L"(VOLTAGE OF VSS TERMINAL) | VOLTAGE OF VDD TERMINAL |

| SECTION | CONT VOLTAGE | CONTX VOLTAGE |
|---|---|---|
| A | "L"(VOLTAGE OF VSS TERMINAL) | VOLTAGE OF VDD TERMINAL |
| B | "H"(VOLTAGE OF VOUT TERMINAL) | "L"(VOLTAGE OF VSS TERMINAL) |
| C | "L"(VOLTAGE OF VSS TERMINAL) | VOLTAGE OF VDD TERMINAL |

VOLTAGE REGULATOR

RELATED APPLICATIONS

This application is a continuation-in-part of U.S. patent application Ser. No. 12/559,966 filed on Sep. 15, 2009, now U.S. Pat. No. 8,198,875 the entire content of which is incorporated herein by reference.

BACKGROUND OF THE INVENTION

1. Field of the Invention

The present invention relates to a voltage regulator having an output terminal connected to a backup battery.

2. Description of the Related Art

Such a circuit as illustrated in FIG. 11 has been known as a conventional voltage regulator having an output terminal connected to a backup battery 112 (see, for example, Japanese Patent Application Laid-open No. 2001-51735).

Power supply voltage is applied between terminals, that is, a VDD terminal 121 and a VSS terminal 123. An output terminal 122 is connected to the backup battery 112, and even when the power supply voltage between the VDD terminal 121 and the VSS terminal 123 becomes zero, a load 113 (for example, RAM) connected to the output terminal 122 may be continued to be supplied with voltage.

While the power supply voltage is supplied between the VDD terminal 121 and the VSS terminal 123, "VBAT1>VBAT2" is normally established, where VBAT1 and VBAT2 represent the voltage between the terminals and the voltage of the backup battery 112, respectively. While the power supply voltage is supplied between the VDD terminal 121 and the VSS terminal 123, a Vref circuit 101 outputs a given constant voltage (Vref), and an error amplifier 102 amplifies a differential voltage between the voltage Vref and a voltage (R2/(R1+R2)×VOUT) determined by dividing the voltage (VOUT) of the output terminal 122 by means of a resistor 107 (whose resistance is R1) and a resistor 108 (whose resistance is R2). Accordingly, a gate of a Pch transistor 103 is controlled so that a constant voltage is output to the output terminal 122.

A comparator 1105 has a positive input terminal connected to a voltage determined by dividing the inter-terminal voltage between the VDD terminal 121 and the VSS terminal 123 by means of a resistor 1101 and a resistor 1102, and has a negative input terminal connected to a voltage determined by dividing an inter-terminal voltage between the output terminal 122 and the VSS terminal 123 by means of a resistor 1103 and a resistor 1104. Then, the comparator 1105 compares the terminal voltage of the VDD terminal 121 with the terminal voltage of the output terminal 122. While the power supply voltage is supplied between the VDD terminal 121 and the VSS terminal 123, the voltage determined by the voltage division by means of the resistor 1101 and the resistor 1102 is higher than the voltage determined by the voltage division by means of the resistor 1103 and the resistor 1104. Therefore, an output of the comparator 1105 becomes "H", and then a Pch transistor 105 is turned ON while a Pch transistor 106 is turned OFF. Accordingly, because of the Pch transistor 105, a substrate (NWELL) potential of the Pch transistor 103 becomes a potential of the VDD terminal 121.

On the other hand, when the inter-terminal voltage between the VDD terminal 121 and the VSS terminal 123 becomes lower than the inter-terminal voltage between the output terminal 122 and the VSS terminal 123, the output of the comparator 1105 becomes "L", and then the Pch transistor 106 is turned ON while the Pch transistor 105 is turned OFF.

Accordingly, because of the Pch transistor 106, the substrate (NWELL) potential of the Pch transistor 103 becomes a potential of the output terminal 122.

In other words, by switching the substrate (NWELL) potential of the Pch transistor 103 to a higher one of the potentials on the VDD terminal 121 side and the output terminal 122 side, even if the voltage of the VDD terminal 121 becomes lower than the voltage of the output terminal 122, a current is prevented from flowing from the output terminal 122 to the VDD terminal 121 via a parasitic diode formed with a substrate of the Pch transistor 103.

However, in the conventional voltage regulator, when the potential on the VDD terminal 121 side becomes zero, a current flows thereinto from the backup battery 112 via the resistor 1103 and the resistor 1104. As a result, there is a problem that a backup operation cannot be performed for a long time.

In addition, there is another problem that a reverse current flows thereinto because the Pch transistor 103 cannot be turned OFF when the potential on the VDD terminal 121 side becomes zero.

SUMMARY OF THE INVENTION

Therefore, it is an object of the present invention to solve the conventional problems described above, and to provide a voltage regulator that is capable of, when the potential on the VDD terminal 121 side becomes zero, achieving lower current consumption of the backup battery and securely preventing the reverse current by turning OFF the Pch transistor 103.

The present invention solves the above-mentioned problems by adopting a circuit configuration in which voltage dividing resistors are not used for a comparator circuit for comparing the voltage of the VDD terminal 121 with the voltage of the output terminal 122 of the voltage regulator, to thereby eliminate a current flowing through the voltage dividing resistors.

According to the voltage regulator of the present invention, which has the configuration described above, irrespective of the magnitude of the voltage of the VDD terminal 121, a reverse current may be prevented from flowing from the output terminal 122 to the VDD terminal 121 with low current consumption.

DETAILED DESCRIPTION OF THE PREFERRED EMBODIMENTS

Referring to the accompanying drawings, embodiment modes of the present invention are described.

First Embodiment

Figure 1:
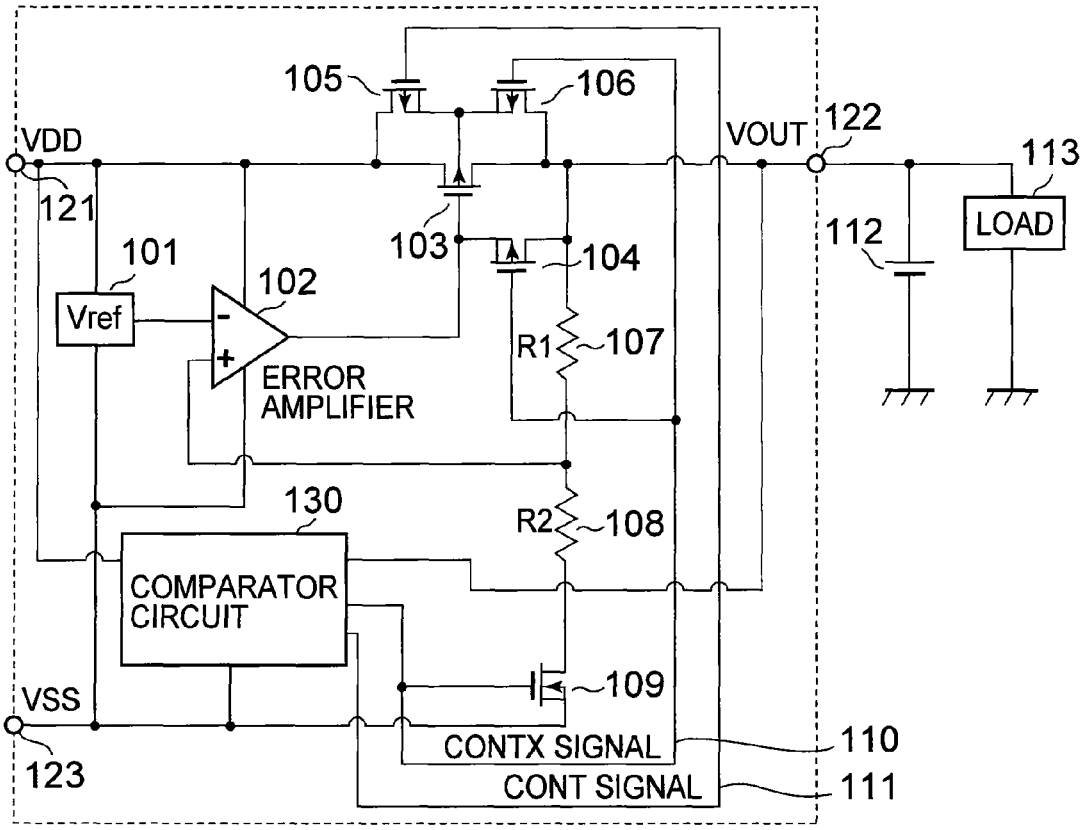
FIG. 1 is a circuit diagram illustrating a voltage regulator according to a first embodiment mode of the present invention.

FIG. 1 is a circuit diagram illustrating a voltage regulator according to a first embodiment of the present invention. The voltage regulator according to the present invention includes a Vref circuit 101, an error amplifier 102, a comparator circuit 130, a resistor 107, a resistor 108, a Pch transistor 103, a Pch transistor 104, a Pch transistor 105, a Pch transistor 106, an Nch transistor 109, a VDD terminal 121, a VSS terminal 123, and an output terminal 122. A difference from FIG. 11 resides in that the comparator 1105 and the resistors 1101, 1102, 1103, and 1104 are eliminated and the comparator circuit 130 controls the Pch transistors 105 and 106 and the added Pch transistor 104.

Figure 2:
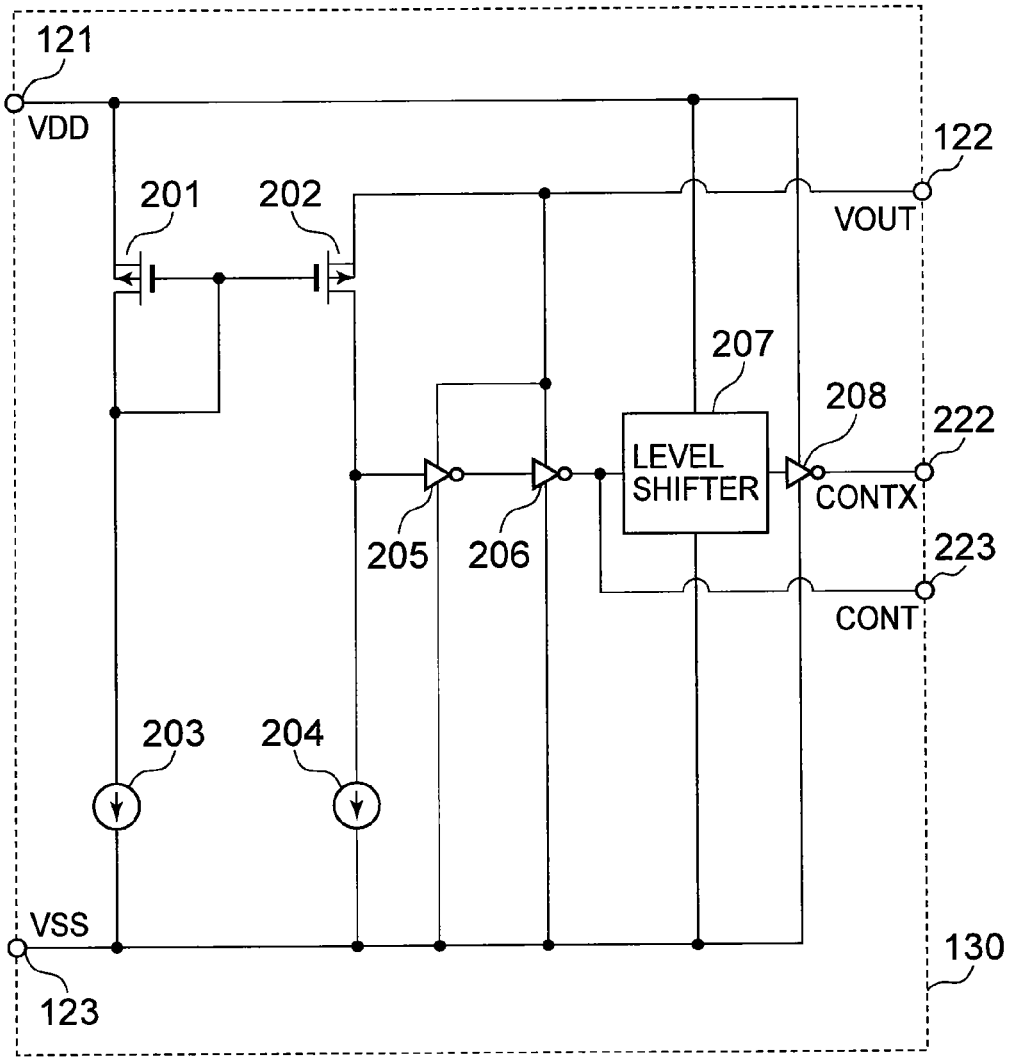
FIG. 2 is a circuit diagram illustrating a first embodiment of a comparator circuit of the voltage regulator according to the present invention.

FIG. 2 illustrates the comparator circuit 130 according to the present invention.

The comparator circuit 130 includes a constant current circuit 203, a constant current circuit 204, a Pch transistor 201, a Pch transistor 202, an inverter 205, an inverter 206, an inverter 208, and a level shifter 207.

A description is given of connections in the voltage regulator according to the present invention. An output of the Vref circuit 101 is connected to an inverting input terminal of the error amplifier 102. A non-inverting input terminal of the error amplifier 102 is connected to a connection point between the resistor 107 and the resistor 108, and an output thereof is connected to a gate of the Pch transistor 103 and a source of the Pch transistor 104. A source of the Pch transistor 103 is connected to the VDD terminal 121 and a drain of the Pch transistor 105. A drain of the Pch transistor 103 is connected to the output terminal 122 and a drain of the Pch transistor 106. A back gate of the Pch transistor 103 is connected to a source of the Pch transistor 105 and a source of the Pch transistor 106. A gate of the Pch transistor 105 is connected to a node 111, and a back gate thereof is connected to the source of the Pch transistor 105. A gate of the Pch transistor 106 is connected to a node 110, and a back gate thereof is connected to the source of the Pch transistor 106. A drain of the Pch transistor 104 is connected to the output terminal 122. A gate of the Pch transistor 104 is connected to the node 110, and a back gate thereof is connected to the output of the error amplifier 102. One side of the resistor 107 is connected to the output terminal 122 while another side thereof is connected to the resistor 108. A gate of the Nch transistor 109 is connected to the node 110. A drain of the Nch transistor 109 is connected to the resistor 108, and a source thereof is connected to the VSS terminal 123. The comparator circuit 130 is connected to the output terminal 122, the VDD terminal 121, the VSS terminal 123, the node 110, and the node 111. The output terminal 122 is connected to a backup battery 112 and a load 113 that are connected in parallel.

Next, a description is given of connections in the comparator circuit 130. A gate of the Pch transistor 201 is connected to a gate of the Pch transistor 202, a drain of the Pch transistor 201, and the constant current circuit 203. A source of the Pch transistor 201 is connected to the VDD terminal 121, and a back gate thereof is connected to the VDD terminal 121. A drain of the Pch transistor 202 is connected to the inverter 205 and the constant current circuit 204. A source of the Pch transistor 202 is connected to the output terminal 122, and a back gate thereof is connected to the output terminal 122. An output of the inverter 205 is connected to the inverter 206, and the inverter 205 is connected to the output terminal 122 for its power supply. An output of the inverter 206 is connected to the level shifter 207 and a CONT terminal 223, and the inverter 206 is connected to the output terminal 122 for its power supply. An output of the level shifter 207 is connected to the inverter 208, and the level shifter 207 is connected to the VDD terminal 121 for its power supply. An output of the inverter 208 is connected to a CONTX terminal 222, and the inverter 208 is connected to the VDD terminal 121 for its power supply. The CONT terminal 223 is connected to the node 111 of FIG. 1 while the CONTX terminal 222 is connected to the node 110 of FIG. 1.

Next, a description is given of operations of the voltage regulator according to the present invention. When a potential of the VDD terminal 121 is higher than a potential of the output terminal 122, a gate-source voltage of the Pch transistor 201 is higher than a gate-source voltage of the Pch transistor 202. Accordingly, a potential of the drain of the Pch transistor 202 becomes "L" level (potential of the VSS terminal 123). With the inverters 205 and 206 for waveform shaping, a voltage of the CONT terminal 223, to which the output of the inverter 206 is connected, becomes "L" level. The level shifter 207 converts the potential level of the output terminal 122 to the potential level of the VDD terminal 121. The inverter 208 inverts an output voltage of the level shifter 207. When the voltage of the CONT terminal 223 is "L" level, the CONTX terminal 222, which corresponds to the output of the inverter 208, has the potential level of the VDD terminal 121. On this occasion, a substrate (NWELL) potential of the Pch transistor 103 illustrated in FIG. 1 becomes the potential of the VDD terminal 121 because the Pch transistor 105 is turned ON while the Pch transistor 106 is turned OFF. In other words, the substrate (NWELL) potential of the Pch transistor 103 becomes a higher one of the potential of the VDD terminal 121 and the potential of the output terminal 122. On this occasion, the Pch transistor 104 is turned OFF. When the VDD terminal 121 is connected to a power source, the potential of the VDD terminal 121 normally becomes higher than the potential of the output terminal 122.

On the other hand, when no power source is connected to the VDD terminal 121, the potential of the VDD terminal 121 becomes lower than the potential of the output terminal 122 because the output terminal 122 is connected to the backup battery 112. On this occasion, the gate-source voltage of the Pch transistor 201 is lower than the gate-source voltage of the Pch transistor 202. Accordingly, the potential of the drain of the Pch transistor 202 becomes "H" level (potential of the output terminal 122). With the inverters 205 and 206 for waveform shaping, the voltage of the CONT terminal 223, which corresponds to the output of the inverter 206, becomes "H" level (potential of the output terminal 122). The level shifter 207 converts the potential level of the output terminal 122 to the potential level of the VDD terminal 121. The inverter 208 inverts the output voltage of the level shifter 207. When the voltage of the CONT terminal 223 is at "H" level (potential of the output terminal 122), the voltage of the CONTX terminal 222, which corresponds to the output of the inverter 208, is "L" level (potential level of the VSS terminal 123). On this occasion, the substrate (NWELL) potential of the Pch transistor 103 illustrated in FIG. 1 becomes the potential of the output terminal 122 because the Pch transistor 106 is turned ON while the Pch transistor 105 is turned OFF. In other words, the substrate (NWELL) potential of the Pch transistor 103 becomes a higher one of the potential of the VDD terminal 121 and the potential of the output terminal 122. On this occasion, the Pch transistor 104 is turned ON, and accordingly the gate of the Pch transistor 103 is allowed to have the same potential as the output terminal 122 so that the Pch transistor 103 is turned OFF. With this, even when the potential of the VDD terminal 121 becomes lower than the potential of the output terminal 122, a current may be prevented by the Pch transistor 103 from flowing from the output terminal 122 to the VDD terminal 121.

Figure 7:
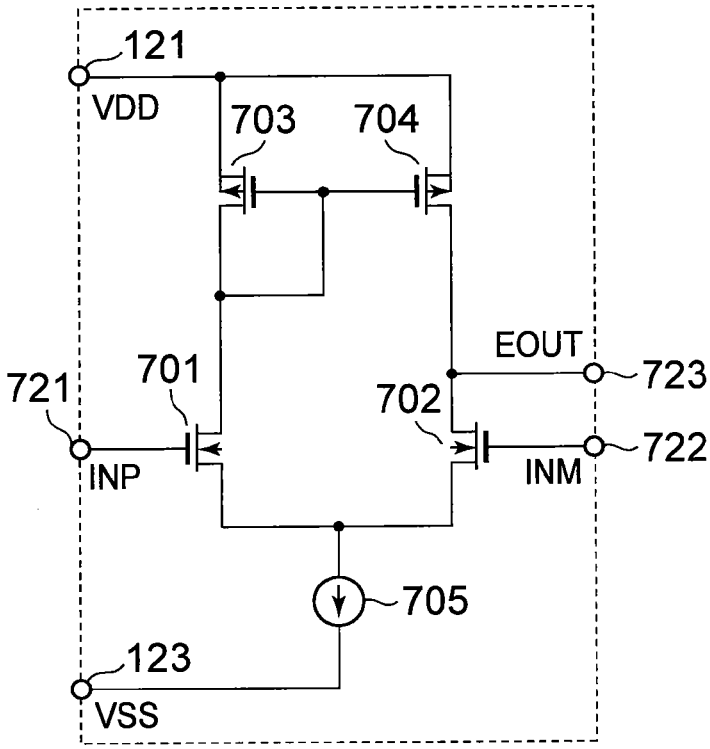
FIG. 7 is a circuit diagram of a general error amplifier of a voltage regulator.
Figure 8:
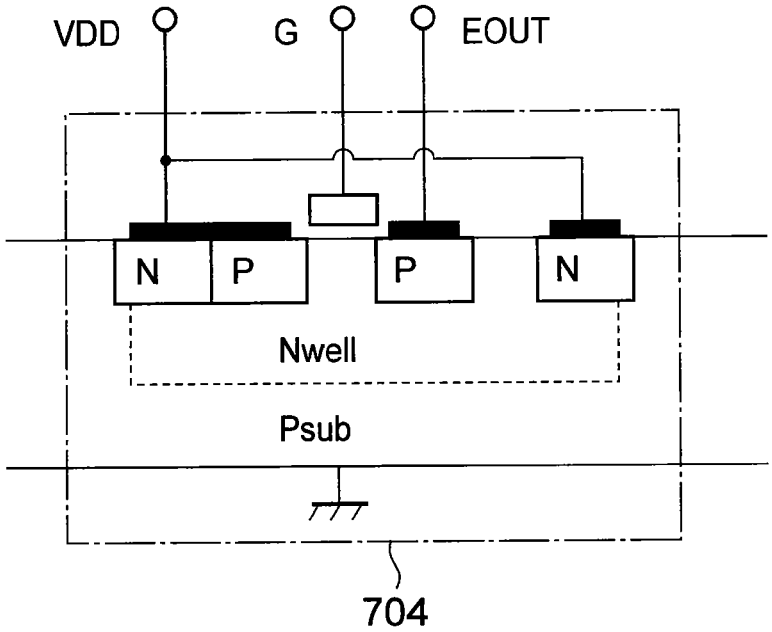
FIG. 8 is a cross sectional view of a P-channel type MOS transistor.

Next, a description is given of the error amplifier 102, which is used in FIG. 1. A configuration of a general error amplifier is as illustrated in FIG. 7. The error amplifier includes a constant current circuit 705, Nch transistors 701 and 702, and Pch transistors 703 and 704. The positive input terminal, the negative input terminal, and the output of the error amplifier are respectively represented by INP 721, INM 722, and EOUT 723. Further, FIG. 8 illustrates a cross sectional view of the Pch transistor 704. Within an NWELL formed on a P-substrate, there exist P-type source and drain regions. The P-substrate is connected to the VSS terminal 123, whose potential is lower. Further, the NWELL is connected to its source (VDD terminal 121).

In a case of using the general error amplifier illustrated in FIG. 7, when the potential of the output terminal 122 becomes higher than the potential of the VDD terminal 121, and when the Pch transistor 104 is accordingly turned ON, the output 723 of the error amplifier 102 is connected to the output terminal 122. At this time, in the case of the general error amplifier illustrated in FIG. 7, a PNP transistor whose emitter, base, and collector respectively correspond to the drain, the source, and the substrate of the transistor 704 is turned ON. As a result, the backup battery 112 is discharged via the Pch transistor 104. To avoid this phenomenon, it is desirable to adopt such a configuration as illustrated in FIG. 9 for the error amplifier.

Figure 9:
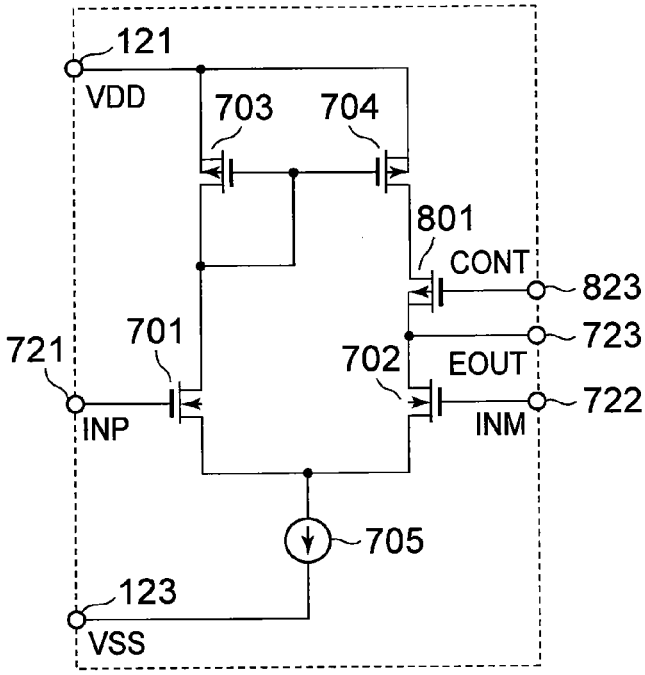
FIG. 9 is a circuit diagram illustrating a second embodiment of an error amplifier of the voltage regulator according to the present invention.
Figure 10:
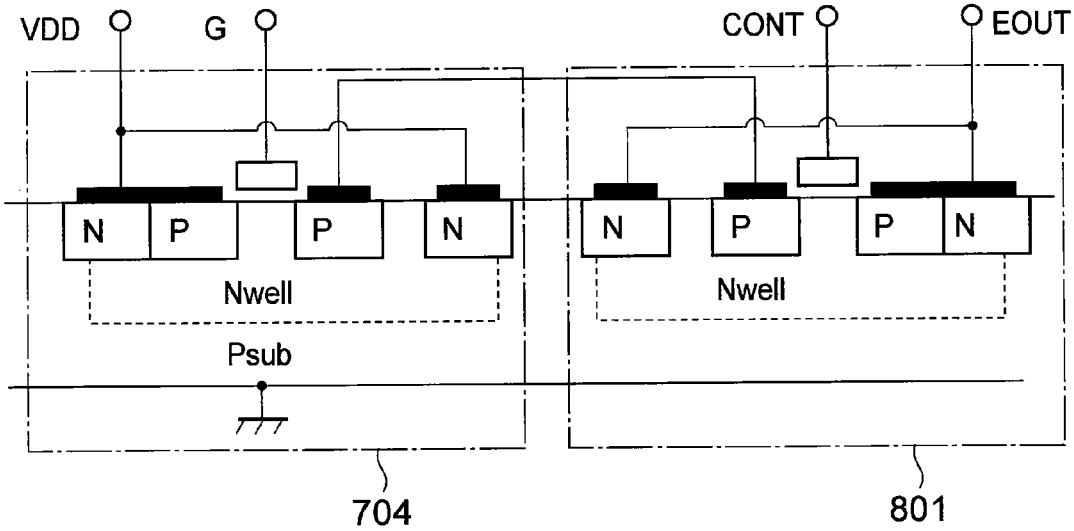
FIG. 10 illustrates cross sectional views of P-channel type MOS transistors.

In FIG. 9 illustrating a second embodiment of the error amplifier 102, a Pch transistor 801 is newly added between the output 723 of the error amplifier and the Pch transistor 704. The Pch transistor 801 has a source and an NWELL that are connected to the output 723 of the error amplifier, a drain connected to the drain of the Pch transistor 704, and a gate controlled by a signal (CONT signal) from the node 111 illustrated in FIG. 1. FIG. 10 illustrates cross sectional views of the Pch transistors 704 and 801. In this case, when the potential of the output terminal 122 becomes higher than the potential of the VDD terminal 121, and when the Pch transistor 104 is accordingly turned ON, the output 723 of the error amplifier 102 is connected to the output terminal 122. However, the signal from the node 111 becomes the same potential as the output terminal 122, and accordingly the Pch transistor 801 is turned OFF. Therefore, a current is not allowed to flow from the drain of the Pch transistor 801 to the drain of the Pch transistor 704.

Further, a difference from FIG. 7 resides in that an Nch transistor 802 is inserted between the constant current circuit 705 and a source of a differential input circuit formed of the Nch transistors 701 and 702. A drain of the Nch transistor 802 is connected to the sources of the Nch transistors 701 and 702. A source of the Nch transistor 802 is connected to the constant current circuit 705, and a gate thereof is connected to a signal (CONTX signal) from the node 110 illustrated in FIG. 1 to be controlled. When the potential of the output terminal 122 becomes higher than the potential of the VDD terminal 121, and when the Pch transistor 104 is accordingly turned ON, the output 723 of the error amplifier 102 is connected to the output terminal 122 so that the Nch transistor 702 enters an ON state. Then, the output terminal 122 and the sources of the Nch transistors 701 and 702 are brought into an electrically-connected state, but the Nch transistor 802 is turned OFF to interrupt a current path of the constant current circuit 705. In this way, a current may be prevented from flowing from the output terminal 122 to the VSS terminal 123 via the Nch transistor 702.

In the description of FIG. 9, the Nch transistor 802 is inserted between the sources of the Nch transistors 701 and 702 and the constant current circuit 705. However, it should be understood that a similar effect can also be obtained when the Nch transistor 802 is inserted between the constant current circuit 705 and the VSS terminal 123. Further, in the description of FIG. 9, the Pch transistor 801 is inserted between the output 723 of the error amplifier 102 and the Pch transistor 704. However, it should be understood that a similar effect can also be obtained when the Pch transistor 801 is inserted between the VDD terminal 121 and the Pch transistor 704.

In FIG. 9, the description has been given taking a one-stage amplifier circuit as an example of the error amplifier, but the error amplifier may be a multi-stage amplifier circuit with two or more stages. In this case, as in FIG. 9, the Pch transistor 801 having a function of interrupting a current path may be inserted between the output of the error amplifier and the VDD terminal, and the Nch transistor 802 having a function of interrupting a current path may be inserted between the output of the error amplifier and the VSS terminal.

Figure 11:
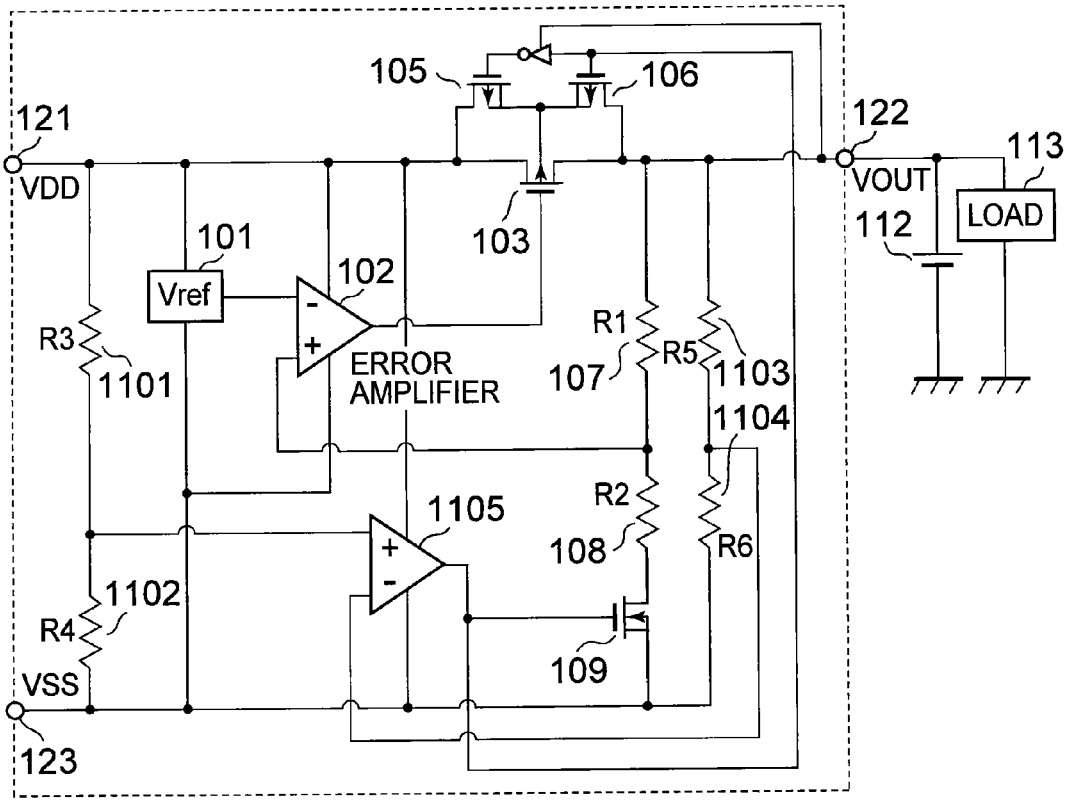
FIG. 11 PRIOR ART
FIG. 11 is a circuit diagram illustrating a conventional voltage regulator.

As described above, compared to the conventional voltage regulator illustrated in FIG. 11, the resistor 1101, the resistor 1102, the resistor 1103, and the resistor 1104 are not provided for comparing the potential of the VDD terminal 121 with the potential of the output terminal 122. As a result, current consumption may be reduced correspondingly. For example, when it is assumed that the voltage of the backup battery 112 is 3 V and a total resistance of the resistor 1103 and the resistor 1104 is 3 Meg Ω, a current of 1 μA from the backup battery 112 is consumed by the resistor 1103 and the resistor 1104. However, in the voltage regulator illustrated in FIG. 1, there is no element equivalent to those resistors, resulting in no consumption corresponding thereto. It is assumed that the comparator 1105 illustrated in FIG. 11 and the comparator circuit 130 illustrated in FIG. 2 have the same current consumption of 0.5 μA. On this occasion, the voltage regulator illustrated in FIG. 11 consumes 1.5 μA from the backup battery 112, whereas the voltage regulator illustrated in FIG. 1 consumes only 0.5 μA therefrom, which is one-third of 1.5 μA. As a result, an operation time period with the backup battery 112 may be extended significantly.

Second Embodiment

Figure 3:
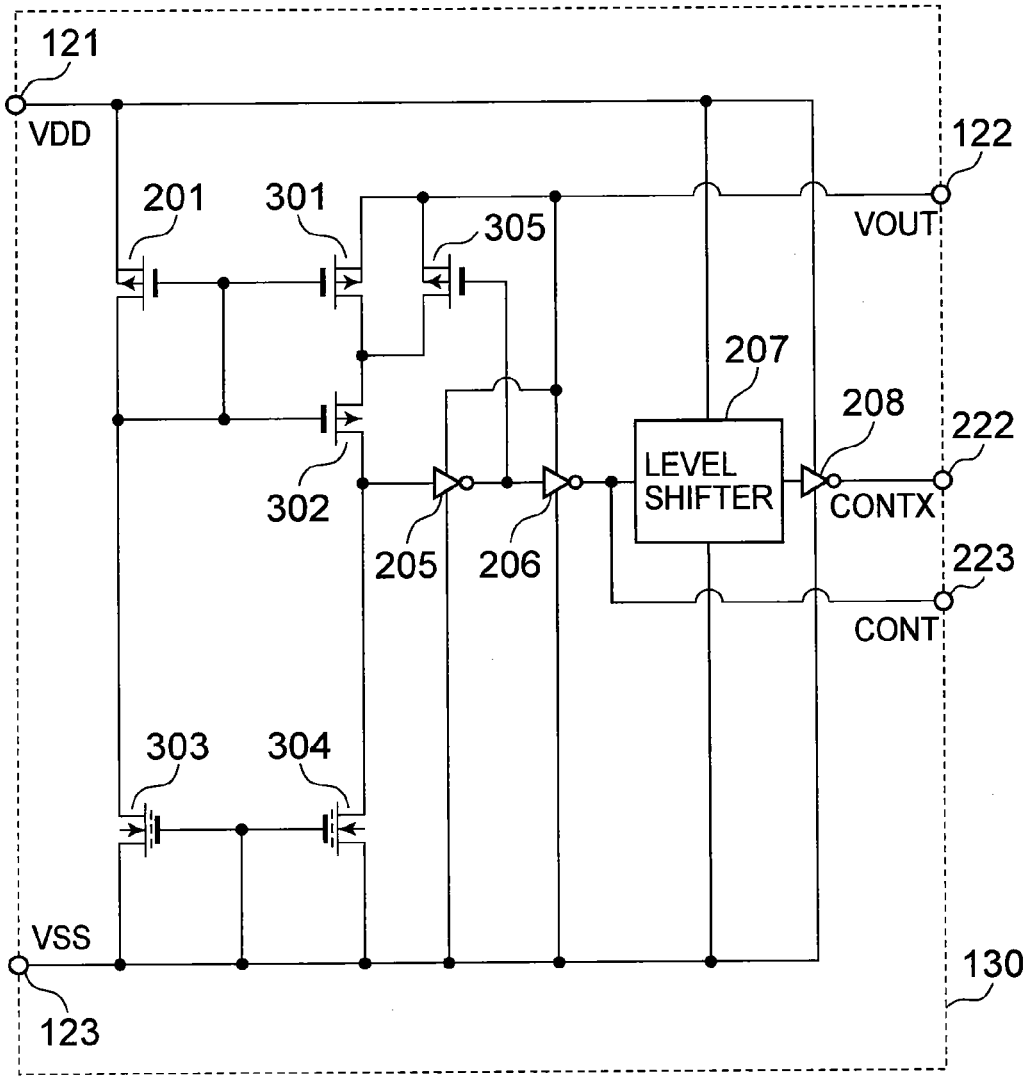
FIG. 3 is a circuit diagram illustrating a second embodiment of the comparator circuit of the voltage regulator according to the present invention.

FIG. 3 illustrates a second embodiment of the comparator circuit 130 of the voltage regulator according to the present invention illustrated in FIG. 1. The comparator circuit 130 according to the second embodiment includes a constant current circuit 303, a constant current circuit 304, the Pch transistor 201, a Pch transistor 301, a Pch transistor 302, a Pch transistor 305, the inverter 205, the inverter 206, the inverter 208, and the level shifter 207. Differences from FIG. 2 reside in that an element equivalent to the Pch transistor 202 is formed of the two transistors, that is, the Pch transistor 301 and the Pch transistor 302, and that the Pch transistor 305 is added for realizing a hysteresis function. Further, each of the constant current circuit 203 and the constant current circuit 204 is specifically illustrated as an N-channel depletion type MOS transistor whose gate and source are connected to the VSS terminal 123.

Next, a description is given of connections in the comparator circuit 130. The gate of the Pch transistor 201 is connected to a gate of the Pch transistor 301, a gate of the Pch transistor 302, a drain of the Pch transistor 201, and the constant current circuit 303. The source of the Pch transistor 201 is connected to the VDD terminal 121, and the back gate thereof is connected to the VDD terminal 121. A drain of the Pch transistor 302 is connected to the inverter 205 and the constant current circuit 304. A source of the Pch transistor 302 is connected to a drain of the Pch transistor 301 and a drain of the Pch transistor 305, and a back gate thereof is connected to the output terminal 122. A source of the Pch transistor 301 is connected to the output terminal 122, and a back gate thereof is connected to the output terminal 122. A gate of the Pch transistor 305 is connected to the output of the inverter 205. A source of the Pch transistor 305 is connected to the output terminal 122, and a back gate thereof is connected to the output terminal 122. The output of the inverter 205 is connected to the inverter 206, and the inverter 205 is connected to the output terminal 122 for its power supply. The output of the inverter 206 is connected to the level shifter 207 and the CONT terminal 223, and the inverter 206 is connected to the output terminal 122 for its power supply. The output of the level shifter 207 is connected to the inverter 208, and the level shifter 207 is connected to the VDD terminal 121 for its power supply. The output of the inverter 208 is connected to the CONTX terminal 222, and the inverter 208 is connected to the VDD terminal 121 for its power supply. The N-channel depletion type MOS transistors are used as the constant current circuit 303 and the constant current circuit 304. Each of the N-channel depletion type MOS transistors has the gate and the source that are connected to the VSS terminal 123, and a drain used as its output. The CONT terminal 223 is connected to the node 111 of FIG. 1 while the CONTX terminal 222 is connected to the node 110 of FIG. 1.

Next, a description is given of operations of the voltage regulator, which uses the comparator circuit according to the second embodiment. When the potential of the VDD terminal 121 is sufficiently higher than the potential of the output terminal 122, the gate-source voltage of the Pch transistor 201 is sufficiently higher than gate-source voltages of the Pch transistor 301 and the Pch transistor 302. Accordingly, a potential of the drain of the Pch transistor 302 becomes "L" level (potential of the VSS terminal 123). With the inverters 205 and 206 for waveform shaping, the output of the inverter 205 becomes "H" (potential of the output terminal 122). Then, the Pch transistor 305 is turned OFF, and the voltage of the CONT terminal 223, which corresponds to the output of the inverter 206, becomes "L" level. The level shifter 207 converts the potential level of the output terminal 122 to the potential level of the VDD terminal 121. The inverter 208 inverts the output voltage of the level shifter 207. When the voltage of the CONT terminal 223 is "L" level, the CONTX terminal 222, which corresponds to the output of the inverter 208, has the potential level of the VDD terminal 121. On this occasion, the substrate (NWELL) potential of the Pch transistor 103 becomes the potential of the VDD terminal 121 because the Pch transistor 105 is turned ON while the Pch transistor 106 is turned OFF. In other words, the substrate (NWELL) potential of the Pch transistor 103 becomes a higher one of the potential of the VDD terminal 121 and the potential of the output terminal 122. On this occasion, the Pch transistor 104 is turned OFF. When the VDD terminal 121 is connected to a power source, the potential of the VDD terminal 121 normally becomes higher than the potential of the output terminal 122.

Subsequently, when the potential of the VDD terminal 121 decreases, because the Pch transistor 305 is turned OFF, the voltage of the VDD terminal 121 is compared with the voltage of the output terminal 122 by means of the Pch transistor 201 and a compound transistor formed of the Pch transistor 301 and the Pch transistor 302. When the potential of the VDD terminal 121 decreases to a potential lower by ΔV1 than the potential of the output terminal 122, the gate-source voltage of the Pch transistor 201 becomes lower by ΔV1 than the gate-source voltages of the Pch transistor 301 and the Pch transistor 302. Accordingly, the potential of the drain of the Pch transistor 302 becomes "H" level (potential of the output terminal 122). With the inverters 205 and 206 for waveform shaping, the output of the inverter 205 becomes "L" level. Then, the Pch transistor 305 is turned ON, and the voltage of the CONT terminal 223, which corresponds to the output of the inverter 206, becomes "H" level (potential of the output terminal 122). The level shifter 207 converts the potential level of the output terminal 122 to the potential level of the VDD terminal 121. The inverter 208 inverts the output voltage of the level shifter 207. When the voltage of the CONT terminal 223 is at "H" level, the CONTX terminal 222, which corresponds to the output of the inverter 208, is "L" level. On this occasion, the substrate (NWELL) potential of the Pch transistor 103 illustrated in FIG. 1 becomes the potential of the output terminal 122 because the Pch transistor 106 is turned ON while the Pch transistor 105 is turned OFF. In other words, the substrate (NWELL) potential of the Pch transistor 103 becomes a higher one of the potential of the VDD terminal 121 and the potential of the output terminal 122. On this occasion, the Pch transistor 104 is turned ON, and accordingly the gate of the Pch transistor 103 is allowed to have the same potential as the output terminal 122 so that the Pch transistor 103 is turned OFF.

The voltage of ΔV1 is determined by Expression (1).

[Expression 1]

$$\Delta V1 = \sqrt{\frac{2 \cdot I}{\mu \cdot \mathrm{Cox}}} \times \left( \sqrt{\frac{L6}{W6}} - \sqrt{\frac{L5}{W5}} \right) \tag{1}$$

In Expression (1), I represents a current value of the constant current circuits 303 and 304; μ, mobility of the Pch transistor 201, the Pch transistor 301, and the Pch transistor 302; L6, a total transistor L-length of the Pch transistor 301 and the Pch transistor 302; L5, a transistor L-length of the Pch transistor 201; W6, a total transistor W-length of the Pch transistor 301 and the Pch transistor 302; and W5, a transistor W-length of the Pch transistor 201.

Subsequently, when the potential of the VDD terminal 121 increases, because the Pch transistor 305 is turned ON, the voltage of the VDD terminal 121 is compared with the voltage of the output terminal 122 by means of the transistors of the Pch transistor 201 and the Pch transistor 302. In the cases where the constant current circuits 303 and 304 have the same current value, and where the Pch transistor 201 and the Pch transistor 302 have the same transistor types (VTH, mobility, etc.), the same L-length, and the same W-length, ΔV1 in Expression (1) satisfies "ΔV1=0". Therefore, when the voltage of the VDD terminal 121 and the voltage of the output terminal 122 are substantially equal to each other, the voltage of the CONT terminal 223 and the voltage of the CONTX terminal 222 are inverted.

Figure 4:
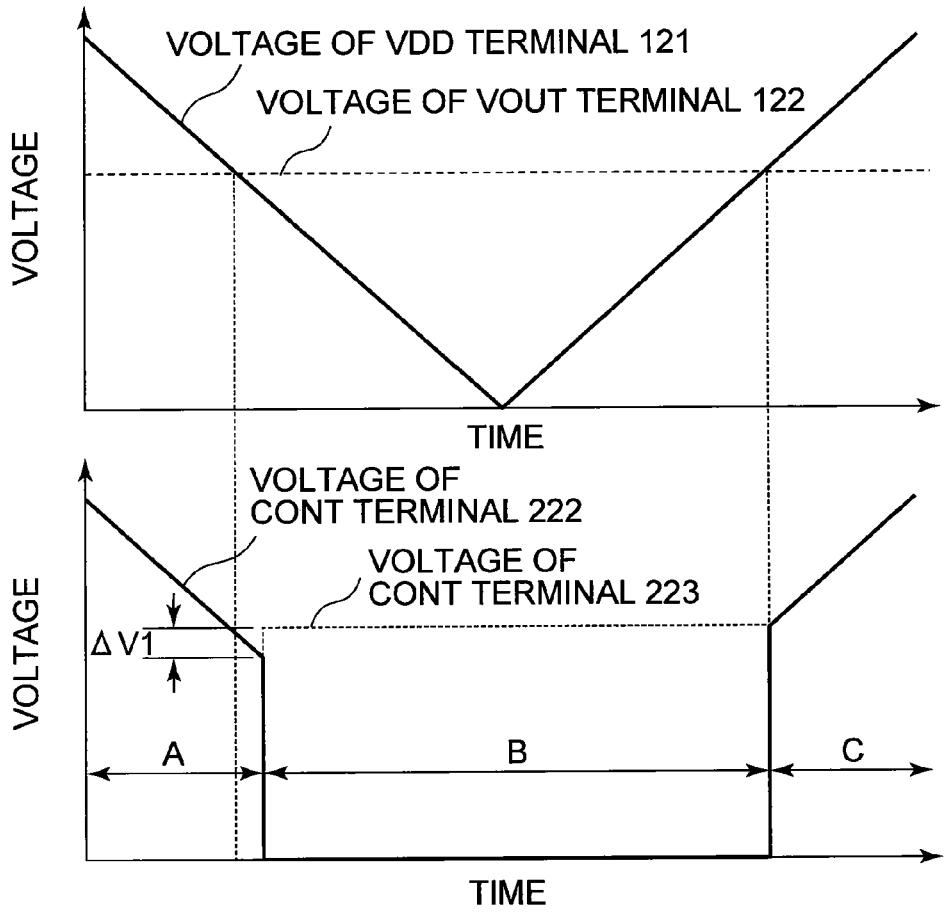
FIG. 4 illustrates voltage waveforms of respective portions of the comparator circuit according to the second embodiment in the voltage regulator of the present invention.

FIG. 4 illustrates voltage waveforms of the CONT terminal 223 and the CONTX terminal 222 of when the voltage of the output terminal 122 is constant while the voltage of the VDD terminal 121 changes, in which the horizontal axis represents time and the vertical axis represents voltage. When the voltage of the VDD terminal 121 decreases to a voltage lower by ΔV1 than the voltage of the output terminal 122, the voltage of the CONT terminal 223 and the voltage of the CONTX terminal 222 are inverted. After that, the voltage of the VDD terminal 121 is raised, and when the voltage of the VDD terminal 121 becomes equal to the voltage of the output terminal 122, the voltage of the CONT terminal 223 and the voltage of the CONTX terminal 222 are inverted. As described above, hysteresis is provided between the voltage of the VDD terminal 121 and the voltage of the output terminal 122, between which the substrate (NWELL) potential of the Pch transistor 103 is switched over. This enables the switching-over of the substrate (NWELL) potential of the Pch transistor 103 to be securely performed without a malfunction even when the voltage of the VDD terminal 121 and the voltage of the output terminal 122 become approximate to each other.

Note that, in order to prevent a parasitic diode formed between the output terminal 122 and the substrate of the Pch transistor 103 from being turned ON when the voltage of the VDD terminal 121 decreases, the value of ΔV1 needs to be set to a forward ON voltage (about 0.6 V) or lower of the parasitic diode. In general, the value of ΔV1 is set to about 50 mV to 200 mV.

Further, the Pch transistor 305 is connected in parallel to the Pch transistor 301 in FIG. 3, but it should be understood that a similar effect can also be obtained when the Pch transistor 305 is connected in parallel to the Pch transistor 302. Further, as has been described in the first embodiment, with regard to the error amplifier, it is desirable to adopt the configuration illustrated in FIG. 9 similarly to the first embodiment.

Third Embodiment

Figure 5:
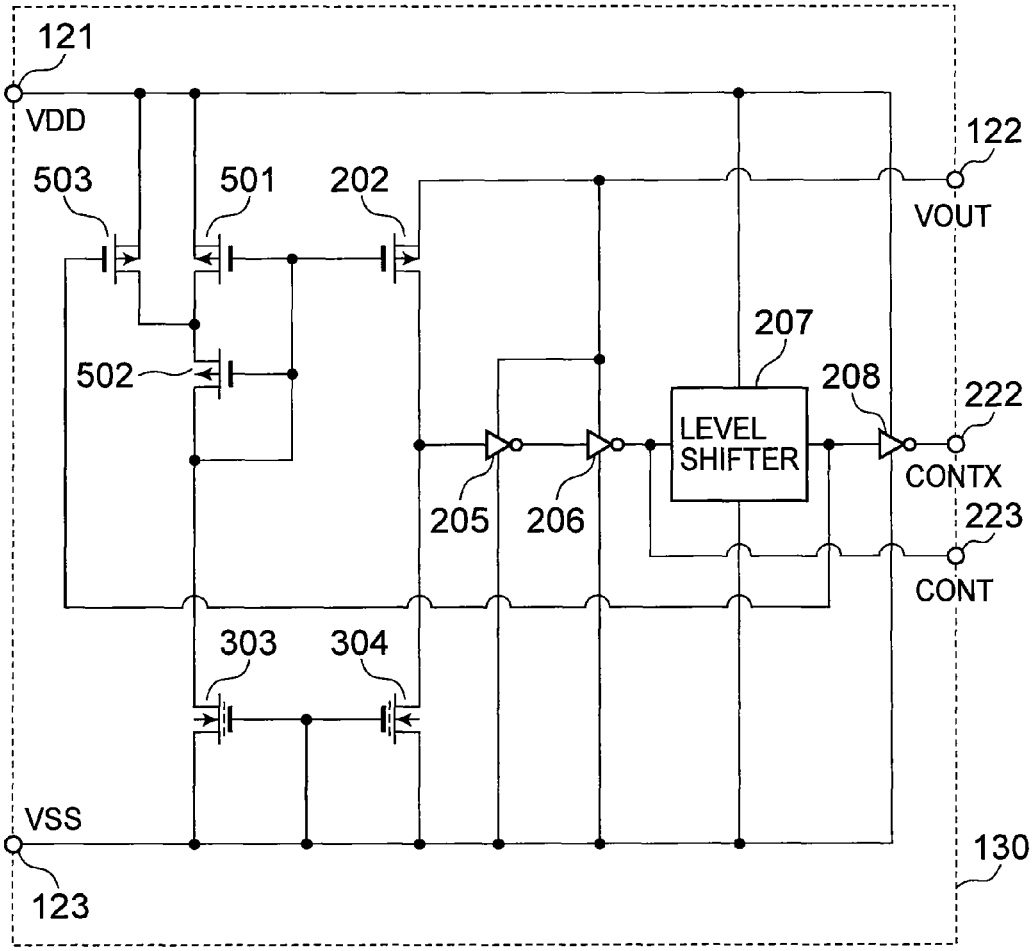
FIG. 5 is a circuit diagram illustrating a third embodiment of the comparator circuit of the voltage regulator according to the present invention.

FIG. 5 illustrates a third embodiment of the comparator circuit 130 of the voltage regulator according to the present invention illustrated in FIG. 1. The comparator circuit 130 according to the third embodiment includes the constant current circuit 303, the constant current circuit 304, the Pch transistor 202, a Pch transistor 501, a Pch transistor 502, a Pch transistor 503, the inverter 205, the inverter 206, the inverter 208, and the level shifter 207. Differences from FIG. 2 reside in that an element equivalent to the Pch transistor 201 is formed of the two transistors, that is, the Pch transistor 501 and the Pch transistor 502, and that the Pch transistor 503 is added for realizing a hysteresis function. Further, similarly to FIG. 3, each of the constant current circuits 203 and 204 is specifically illustrated as the N-channel depletion type MOS transistor whose gate and source are connected to the VSS terminal 123.

Next, a description is given of connections in the comparator circuit 130. A gate of the Pch transistor 501 is connected to the gate of the Pch transistor 202, a gate of the Pch transistor 502, a drain of the Pch transistor 502, and the constant current circuit 303. A source of the Pch transistor 501 is connected to the VDD terminal 121. A drain of the Pch transistor 501 is connected to a source of the Pch transistor 502 and a drain of the Pch transistor 503, and a back gate thereof is connected to the VDD terminal 121. A gate of the Pch transistor 503 is connected to the output of the level shifter 207. A source of the Pch transistor 503 is connected to the VDD terminal 121, and a back gate thereof is connected to the VDD terminal 121. The drain of the Pch transistor 202 is connected to the inverter 205 and the constant current circuit 304. A source of the Pch transistor 202 is connected to the output terminal 122, and a back gate thereof is connected to the output terminal 122. The output of the inverter 205 is connected to the inverter 206, and the inverter 205 is connected to the output terminal 122 for its power supply. The output of the inverter 206 is connected to the level shifter 207 and the CONT terminal 223, and the inverter 206 is connected to the output terminal 122 for its power supply. The output of the level shifter 207 is connected to the inverter 208, and the level shifter 207 is connected to the VDD terminal 121 for its power supply. The output of the inverter 208 is connected to the CONTX terminal 222, and the inverter 208 is connected to the VDD terminal 121 for its power supply. The N-channel depletion type MOS transistors are used as the constant current circuit 303 and the constant current circuit 304. Each of the N-channel depletion type MOS transistors has the gate and the source that are connected to the VSS terminal 123, and a drain used as its output. The CONT terminal 223 is connected to the node 111 of FIG. 1 while the CONTX terminal 222 is connected to the node 110 of FIG. 1.

Next, a description is given of operations of the voltage regulator, which uses the comparator circuit according to the third embodiment. When the potential of the VDD terminal 121 is sufficiently higher than the potential of the output terminal 122, the Pch transistor 501 and the Pch transistor 502 are turned ON while the Pch transistor 202 is turned OFF. Accordingly, the potential of the drain of the Pch transistor 202 becomes "L" level (potential of the VSS terminal 123). With the inverters 205 and 206 for waveform shaping, the voltage of the CONT terminal 223, which corresponds to the output of the inverter 206, becomes "L" level. The level shifter 207 converts the potential level of the output terminal 122 to the potential level of the VDD terminal 121. The inverter 208 inverts the output voltage of the level shifter 207. When the voltage of the CONT terminal 223 is "L" level, the output of the level shifter 207 is "L" level. Accordingly, the Pch transistor 503 is turned ON, and the CONTX terminal 222, which corresponds to the output of the inverter 208, has the potential level of the VDD terminal 121. On this occasion, the substrate (NWELL) potential of the Pch transistor 103 illustrated in FIG. 1 becomes the potential of the VDD terminal 121 because the Pch transistor 105 is turned ON while the Pch transistor 106 is turned OFF. In other words, the substrate (NWELL) potential of the Pch transistor 103 becomes a higher one of the potential of the VDD terminal 121 and the potential of the output terminal 122. On this occasion, the Pch transistor 104 is turned OFF. When the VDD terminal 121 is connected to a power source, the potential of the VDD terminal 121 normally becomes higher than the potential of the output terminal 122.

Subsequently, when the potential of the VDD terminal 121 decreases, because the Pch transistor 503 is turned ON, the voltage of the VDD terminal 121 is compared with the voltage of the output terminal 122 by means of the Pch transistor 502 and the Pch transistor 202. In the cases where the constant current circuits 303 and 304 have the same current value, and where the Pch transistor 502 and the Pch transistor 202 have the same transistor types (VTH, mobility, etc.), the same L-length, and the same W-length, when the potential of the VDD terminal 121 decreases to substantially the same value as the potential of the output terminal 122, the Pch transistor 502 is turned OFF while the Pch transistor 202 is turned ON. Accordingly, the potential of the drain of the Pch transistor 202 becomes "H" level (potential of the output terminal 122). With the inverters 205 and 206 for waveform shaping, the voltage of the CONT terminal 223, which corresponds to the output of the inverter 206, becomes "H" level (potential of the output terminal 122). The level shifter 207 converts the potential level of the output terminal 122 to the potential level of the VDD terminal 121. The inverter 208 inverts the output voltage of the level shifter 207. When the voltage of the CONT terminal 223 is at "H" level, the output of the level shifter 207 corresponds to the voltage of the VDD terminal 121. Accordingly, the Pch transistor 503 is turned OFF, and the voltage of the CONTX terminal 222, which corresponds to the output of the inverter 208, becomes "L" level. On this occasion, the substrate (NWELL) potential of the Pch transistor 103 becomes the potential of the output terminal 122 because the Pch transistor 106 is turned ON while the Pch transistor 105 is turned OFF. In other words, the substrate (NWELL) potential of the Pch transistor 103 becomes a higher one of the potential of the VDD terminal 121 and the potential of the output terminal 122. On this occasion, the Pch transistor 104 is turned ON, and accordingly the gate of the Pch transistor 103 is allowed to have the same potential as the output terminal 122 so that the Pch transistor 103 is turned OFF.

Subsequently, when the potential of the VDD terminal 121 increases, because the Pch transistor 503 is turned OFF, the voltage of the VDD terminal 121 is compared with the voltage of the output terminal 122 by means of the Pch transistor 202 and a compound transistor formed of the Pch transistor 501 and the Pch transistor 502. When the voltage of the VDD terminal 121 increases to a voltage higher by ΔV2 than the voltage of the output terminal 122, the voltage of the CONT terminal 223 and the voltage of the CONTX terminal 222 are inverted.

The voltage of ΔV2 is determined by Expression (2).

[Expression 2]

$$\Delta V2 = \sqrt{\frac{2 \cdot I}{\mu \cdot \mathrm{Cox}}} \times \left( \sqrt{\frac{L5}{W5}} - \sqrt{\frac{L6}{W6}} \right) \tag{2}$$

In Expression (2), I represents a current value of the constant current circuits 303 and 304; μ, mobility of the Pch transistor 202, the Pch transistor 501, and the Pch transistor 502; L6, a transistor L-length of the Pch transistor 202; L5, a total transistor L-length of the Pch transistor 501 and the Pch transistor 502; W6, a transistor W-length of the Pch transistor 202; and W5, a total transistor W-length of the Pch transistor 501 and the Pch transistor 502.

Figure 6:
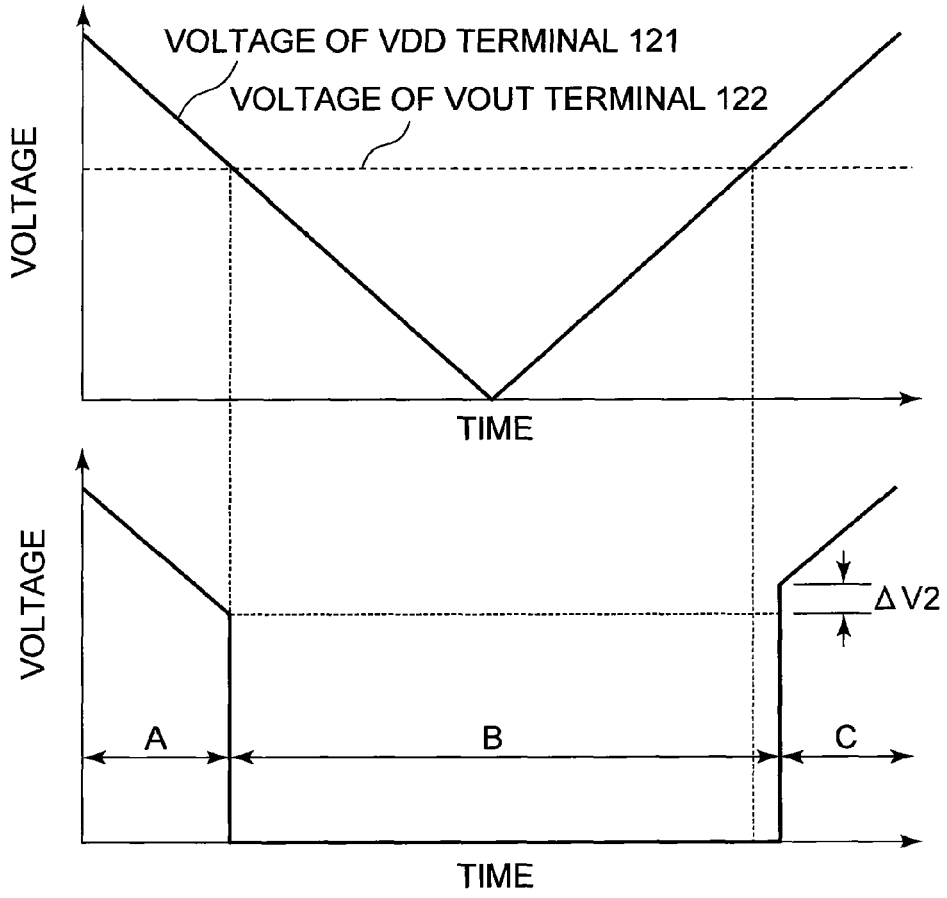
FIG. 6 illustrates voltage waveforms of respective portions of the comparator circuit according to the third embodiment in the voltage regulator of the present invention.

FIG. 6 illustrates voltage waveforms of the CONT terminal 223 and the CONTX terminal 222 of when the voltage of the output terminal 122 is constant while the voltage of the VDD terminal 121 changes, in which the horizontal axis represents time and the vertical axis represents voltage. When the voltage of the VDD terminal 121 decreases to be equal to the voltage of the output terminal 122, the voltage of the CONT terminal 223 and the voltage of the CONTX terminal 222 are inverted. After that, the voltage of the VDD terminal 121 is raised, and when the voltage of the VDD terminal 121 becomes higher by ΔV2 than the voltage of the output terminal 122, the voltage of the CONT terminal 223 and the voltage of the CONTX terminal 222 are inverted. As described above, hysteresis is provided between the voltage of the VDD terminal 121 and the voltage of the output terminal 122, between which the substrate (NWELL) potential of the Pch transistor 103 is switched over. This enables the switching-over of the substrate (NWELL) potential of the Pch transistor 103 to be securely performed without a malfunction even when the voltage of the VDD terminal 121 and the voltage of the output terminal 122 become approximate to each other.

Note that, in order to prevent a parasitic diode formed between the VDD terminal 121 and the substrate of the Pch transistor 103 from being turned ON when the voltage of the VDD terminal 121 increases, the value of ΔV2 needs to be set to a forward ON voltage (about 0.6 V) or lower of the parasitic diode. In general, the value of ΔV2 is set to about 50 mV to 200 mV.

Further, the Pch transistor 503 is connected in parallel to the Pch transistor 501 in FIG. 5, but it should be understood that a similar effect can also be obtained when the Pch transistor 503 is connected in parallel to the Pch transistor 502. Further, as has been described in the first embodiment, with regard to the error amplifier, it is desirable to adopt the configuration illustrated in FIG. 9 similarly to the first embodiment.

Fourth Embodiment

Figure 12:
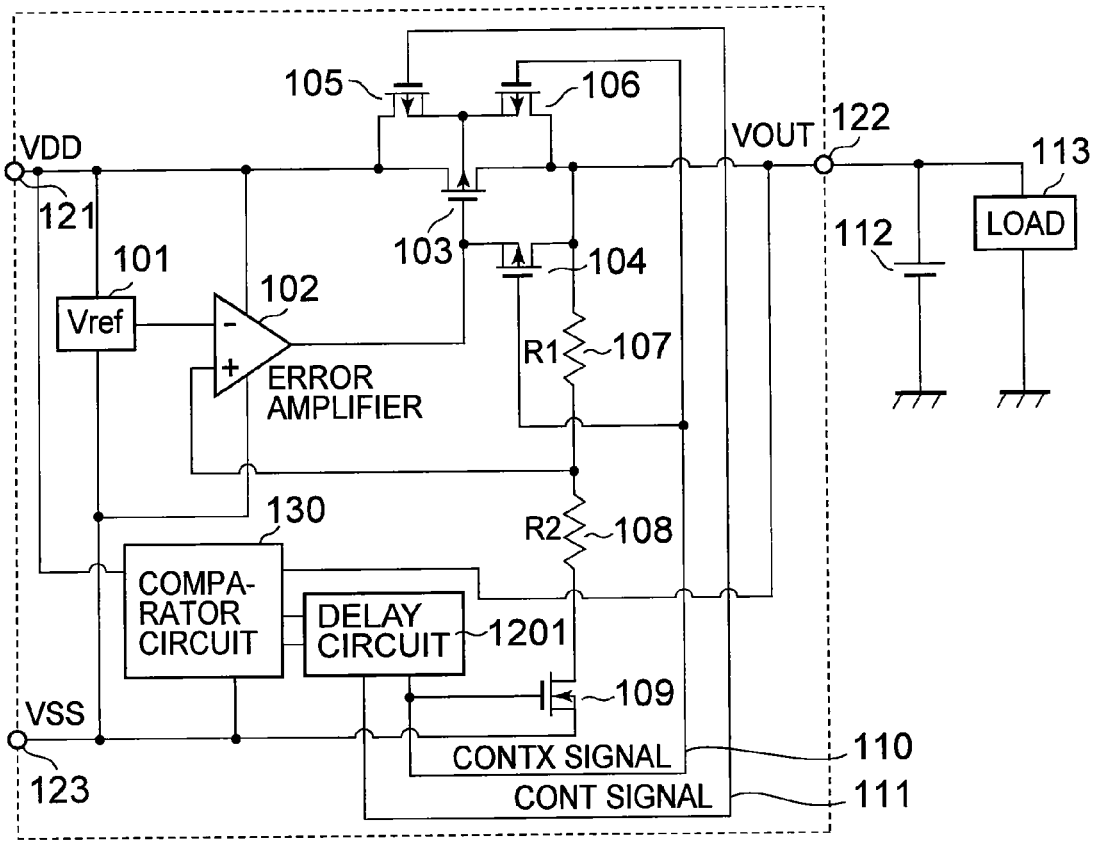
FIG. 12 is a circuit diagram illustrating a voltage regulator according to a second embodiment mode of the present invention.

FIG. 12 illustrates a circuit diagram of a voltage regulator according to a second embodiment mode of the present invention. Differences from FIG. 1 reside in that the back gate of the Pch transistor 104 is connected to the back gate of the Pch transistor 103, and that a delay circuit 1201 is added to the outputs of the comparator circuit 130. Connections are made such that the outputs of the comparator circuit 130 are connected to the delay circuit 1201, and the outputs of the delay circuit 1201 correspond to the outputs of the node 110 and the node 111.

Next, a description is given of operations of the voltage regulator according to the second embodiment mode. When the voltage of the VDD terminal 121 is higher than the voltage of the output terminal 122, the voltage of the node 111 is at "L" level while the voltage of the node 110 is at "H" level. Accordingly, the Pch transistor 105 is turned ON while the Pch transistor 106 is turned OFF. On this occasion, the substrate (NWELL) potential of the Pch transistor 104 becomes the voltage of the VDD terminal 121, and hence the Pch transistor 104 can be turned OFF without fail.

The delay circuit 1201 uses a timer circuit to prevent the voltages of the node 110 and the node 111 from becoming "L" level simultaneously. This prevents the Pch transistors 105 and 106 from being turned ON simultaneously and a current from flowing from the VDD terminal 121 to the output terminal 122 or from the output terminal 122 to the VDD terminal 121.

Note that, the voltage regulator according to the second embodiment mode may be allowed to operate without the delay circuit 1201, though in this case there is a problem that the Pch transistors 105 and 106 may be turned ON simultaneously.

Fifth Embodiment

Figure 13:
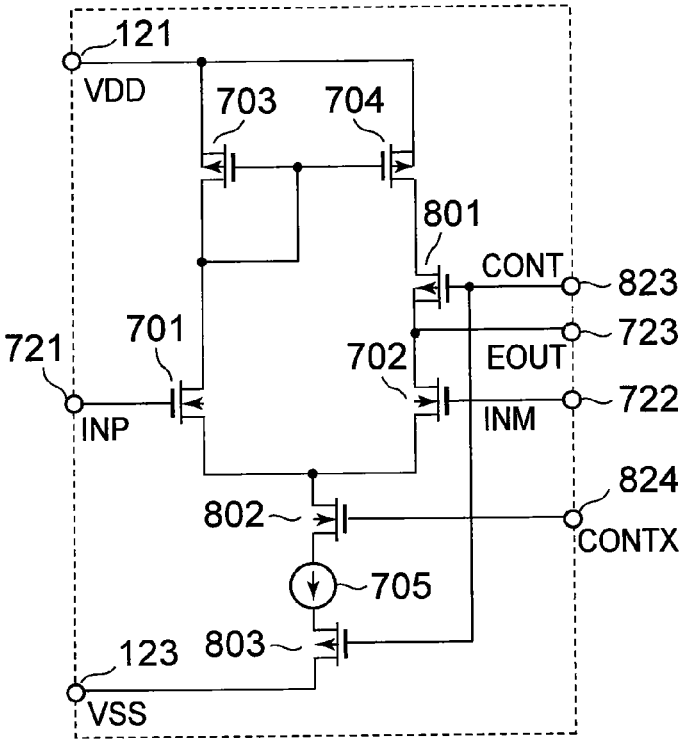
FIG. 13 is a circuit diagram illustrating a third embodiment of the error amplifier of the voltage regulator according to the present invention.

FIG. 13 illustrates a third embodiment of the error amplifier 102 of the voltage regulator according to the present invention illustrated in FIG. 1. A difference from FIG. 9 resides in that a Pch transistor 803 is inserted downstream of the constant current circuit 705, which has a gate connected to a CONT terminal 823.

Next, a description is given of an operation. When the potential of the output terminal 122 becomes higher than the potential of the VDD terminal 121, and when the Pch transistor 104 is accordingly turned ON, the output 723 of the error amplifier 102 is connected to the output terminal 122. Because the Nch transistor 702 is in the ON state, the output terminal 122 and the sources of the Nch transistors 701 and 702 are brought into the electrically-connected state. Then, the Nch transistor 802 and the Pch transistor 803 are turned OFF, to thereby interrupt the current path of the constant current circuit 705 to prevent a current from flowing from the output terminal 122 to the VSS terminal 123 via the Nch transistor 702.

In FIG. 13, the description has been given taking a one-stage amplifier circuit as an example of the error amplifier, but the error amplifier may be a multi-stage amplifier circuit with two or more stages. In this case, as in FIG. 13, the Pch transistor 801 having a function of interrupting a current path may be inserted between the output of the error amplifier and the VDD terminal, and the Nch transistor 802 and the Pch transistor 803 having a function of interrupting a current path may be inserted between the output of the error amplifier and the VSS terminal.

Sixth Embodiment

Figure 14:
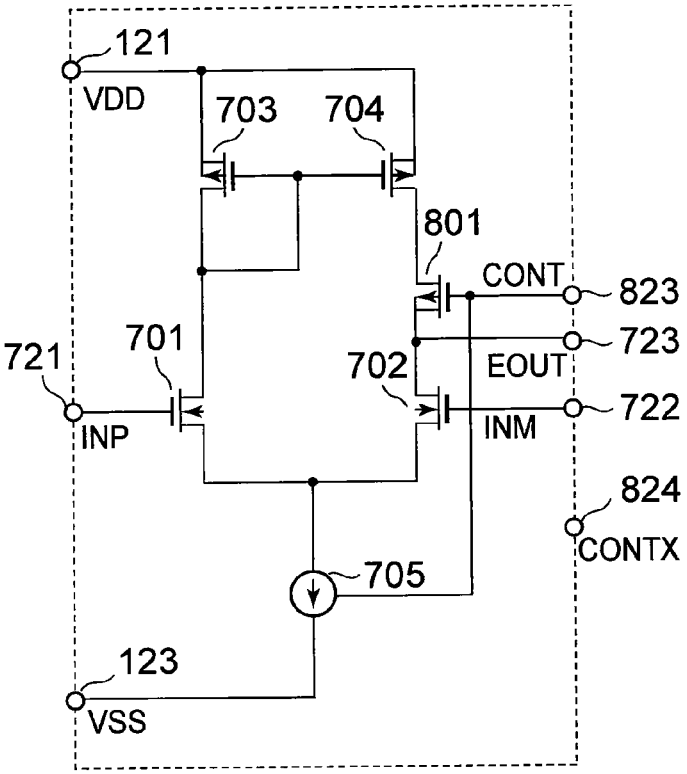
FIG. 14 is a circuit diagram illustrating a fourth embodiment of the error amplifier of the voltage regulator according to the present invention.

FIG. 14 illustrates a fourth embodiment of the error amplifier 102 of the voltage regulator according to the present invention illustrated in FIG. 1. Differences from FIG. 13 reside in that the Nch transistor 802 and the Pch transistor 803 are eliminated, and that the CONT terminal 823 is connected to the constant current circuit 705.

Next, a description is given of an operation. When the potential of the output terminal 122 becomes higher than the potential of the VDD terminal 121, and when the Pch transistor 104 and the Pch transistor 801 are accordingly turned ON and OFF, respectively, the output 723 of the error amplifier 102 is connected to the output terminal 122. Because the Nch transistor 702 is in the ON state, the output terminal 122 and the sources of the Nch transistors 701 and 702 are brought into the electrically-connected state. Then, by the signal from the CONT terminal 823, the constant current circuit 705 is turned OFF to interrupt a current path so that a current is prevented from flowing from the output terminal 122 to the VSS terminal 123 via the Nch transistor 702.

In FIG. 14, the description has been given taking a one-stage amplifier circuit as an example of the error amplifier, but the error amplifier may be a multi-stage amplifier circuit with two or more stages. In this case, the constant current circuit may be configured to be turned OFF by the signal from the CONT terminal 823.

What is claimed is:

1. A voltage regulator, comprising:

an output transistor provided between a power supply terminal and an output terminal;

an error amplifier for controlling a gate voltage of the output transistor so that a voltage of the output terminal becomes constant;

a second transistor for connecting a substrate of the output transistor to the power supply terminal;

a third transistor for connecting the substrate of the output transistor to the output terminal; and a comparator circuit for comparing a voltage of the power supply terminal with the voltage of the output terminal, and performing control of switching the second transistor and the third transistor based on a result of the comparing, wherein:

the comparator circuit comprises:

a fourth transistor including a source connected to the power supply terminal, a gate connected to a drain, and the drain connected to a first constant current circuit; and a fifth transistor including a source connected to the output terminal, a gate connected to the gate of the fourth transistor, and a drain connected to a second constant current circuit; and the comparator circuit outputs the result of the comparing based on a voltage of a connection point between the fifth transistor and the second constant current circuit; and a delay circuit for receiving the output of the comparator circuit to perform control of switching the second transistor and the third transistor, wherein the delay circuit performs the control to prevent the second transistor and the third transistor from being turned ON simultaneously.

2. A voltage regulator according to claim 1, wherein the comparator circuit is configured to:

turn ON the second transistor when the voltage of the power supply terminal is higher than the voltage of the output terminal; and turn ON the third transistor when the voltage of the power supply terminal is lower than the voltage of the output terminal.

3. A voltage regulator according to claim 2, wherein the comparator circuit has a hysteresis function.

4. A voltage regulator according to claim 3, wherein:

the comparator circuit further comprises:

a sixth transistor connected in series to the fifth transistor; and a seventh transistor connected in parallel to the fifth transistor; and the hysteresis function is realized by controlling the seventh transistor based on the output of the comparator circuit.

5. A voltage regulator according to claim 3, wherein:

the comparator circuit further comprises:

an eighth transistor connected in series to the fourth transistor; and a ninth transistor connected in parallel to the fourth transistor; and the hysteresis function is realized by controlling the ninth transistor based on the output of the comparator circuit.

6. A voltage regulator, comprising:

an output transistor provided between a power supply terminal and an output terminal;

an error amplifier for controlling a gate voltage of the output transistor so that a voltage of the output terminal becomes constant;

a second transistor for connecting a substrate of the output transistor to the power supply terminal;

a third transistor for connecting the substrate of the output transistor to the output terminal; and a comparator circuit for comparing a voltage of the power supply terminal with the voltage of the output terminal, and performing control of switching the second transistor and the third transistor based on a result of the comparing, wherein:

the comparator circuit comprises:

a fourth transistor including a source connected to the power supply terminal, a gate connected to a drain, and the drain connected to a first constant current circuit; and a fifth transistor including a source connected to the output terminal, a gate connected to the gate of the fourth transistor, and a drain connected to a second constant current circuit; and the comparator circuit outputs the result of the comparing based on a voltage of a connection point between the fifth transistor and the second constant current circuit, wherein the error amplifier comprises:

a tenth transistor provided between an output of the error amplifier and the power supply terminal, including a substrate that is connected to the output of the error amplifier; and an eleventh transistor provided between the output of the error amplifier and a ground terminal; and the tenth transistor and the eleventh transistor are turned OFF when the voltage of the output terminal is higher than the voltage of the power supply terminal.

7. A voltage regulator, comprising:

an output transistor provided between a power supply terminal and an output terminal;

an error amplifier for controlling a gate voltage of the output transistor so that a voltage of the output terminal becomes constant;

a second transistor for connecting a substrate of the output transistor to the power supply terminal;

a third transistor for connecting the substrate of the output transistor to the output terminal; and a comparator circuit for comparing a voltage of the power supply terminal with the voltage of the output terminal, and performing control of switching the second transistor and the third transistor based on a result of the comparing, wherein:

the comparator circuit comprises:

a fourth transistor including a source connected to the power supply terminal, a gate connected to a drain, and the drain connected to a first constant current circuit; and a fifth transistor including a source connected to the output terminal, a gate connected to the gate of the fourth transistor, and a drain connected to a second constant current circuit; and the comparator circuit outputs the result of the comparing based on a voltage of a connection point between the fifth transistor and the second constant current circuit, wherein the error amplifier comprises:

a tenth transistor provided between an output of the error amplifier and the power supply terminal, including a substrate that is connected to the output of the error amplifier;

an eleventh transistor provided between the output of the error amplifier and a third constant current circuit; and a twelfth transistor provided between the third constant current circuit and a ground terminal; and the tenth transistor, the eleventh transistor, and the twelfth transistor are turned OFF when the voltage of the output terminal is higher than the voltage of the power supply terminal.

8. A voltage regulator, comprising:

an output transistor provided between a power supply terminal and an output terminal;

an error amplifier for controlling a gate voltage of the output transistor so that a voltage of the output terminal becomes constant;

a second transistor for connecting a substrate of the output transistor to the power supply terminal;

a third transistor for connecting the substrate of the output transistor to the output terminal; and a comparator circuit for comparing a voltage of the power supply terminal with the voltage of the output terminal, and performing control of switching the second transistor and the third transistor based on a result of the comparing, wherein:

the comparator circuit comprises:

a fourth transistor including a source connected to the power supply terminal, a gate connected to a drain, and the drain connected to a first constant current circuit; and a fifth transistor including a source connected to the output terminal, a gate connected to the gate of the fourth transistor, and a drain connected to a second constant current circuit; and the comparator circuit outputs the result of the comparing based on a voltage of a connection point between the fifth transistor and the second constant current circuit wherein the error amplifier comprises:

a tenth transistor provided between an output of the error amplifier and the power supply terminal, including a substrate that is connected to the output of the error amplifier; and a third constant current circuit; and the third constant current circuit is turned OFF when the voltage of the output terminal is higher than the voltage of the power supply terminal.

9. A voltage regulator, comprising:

an output transistor provided between a power supply terminal and an output terminal;

an error amplifier for controlling a gate voltage of the output transistor so that a voltage of the output terminal becomes constant;

a second transistor for connecting a substrate of the output transistor to the power supply terminal;

a third transistor for connecting the substrate of the output transistor to the output terminal; and a comparator circuit for comparing a voltage of the power supply terminal with the voltage of the output terminal, and performing control of switching the second transistor and the third transistor based on a result of the comparing, wherein:

the comparator circuit comprises:

a fourth transistor including a source connected to the power supply terminal, a gate connected to a drain, and the drain connected to a first constant current circuit; and a fifth transistor including a source connected to the output terminal, a gate connected to the gate of the fourth transistor, and a drain connected to a second constant current circuit; and the comparator circuit outputs the result of the comparing based on a voltage of a connection point between the fifth transistor and the second constant current circuit, a sixth transistor for connecting an output of the error amplifier to the output terminal, wherein the sixth transistor includes a substrate connected to the substrate of the output transistor.

* * * * *